United States Patent [19]

Potter

[11] Patent Number: 5,028,921

[45] Date of Patent: Jul. 2, 1991

[54] VEHICLE DETECTOR METHOD AND SYSTEM

[75] Inventor: Thomas R. Potter, Los Alamitos, Calif.

[73] Assignee: Detector Systems, Inc., Stanton, Calif.

[21] Appl. No.: 333,824

[22] Filed: Apr. 4, 1989

Related U.S. Application Data

[63] Continuation of Ser. No. 77,933, Jul. 27, 1987, abandoned.

[51] Int. Cl.[5] ..... G08G 1/01

[52] U.S. Cl. ..... 340/939; 377/9; 340/941

[58] Field of Search ..... 340/939, 941; 377/9, 377/19; 364/424

[56] References Cited

U.S. PATENT DOCUMENTS

| | | | |
|---|---|---|---|
| 3,868,626 | 2/1975 | Masher | 340/939 |
| 3,943,339 | 3/1976 | Koerner et al. | 340/939 |
| 3,989,939 | 11/1976 | Koerner | 340/941 |
| 4,131,848 | 12/1978 | Battle . | |
| 4,391,119 | 7/1983 | Price et al. | 340/941 |
| 4,491,841 | 1/1985 | Clark | 340/941 |
| 4,668,951 | 5/1987 | Duley et al. | 340/941 |

FOREIGN PATENT DOCUMENTS 2131994 6/1984 United Kingdom .

*Primary Examiner*—Joseph A. Orsino
*Assistant Examiner*—Jeffery A. Hofsass
*Attorney, Agent, or Firm*—Townsend & Townsend

[57] ABSTRACT

A method of updating the reference count in a period shift measurement vehicle detector permits conditional reference count updating in the No Call direction whenever the sample count minus reference count difference value lies between the upper limit of a jitter/vibration guard and band and a positive freeze reference threshold. Decrementing of the reference count is permitted in the call direction whenever the sample count minus reference count lies in a range from 0 to a negative freeze reference threshold. Variable hysteresis for call/no call signal generation is provided in a single vehicle detector, with the call direction threshold selectable between two values.

51 Claims, 25 Drawing Sheets

VEHICLE DETECTOR METHOD AND SYSTEM

This is a continuation of application Ser. No. 077,933, filed July 27, 1987, now abandoned.

A portion of the disclosure of this patent document contains material which is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

BACKGROUND OF THE INVENTION

This invention relates to vehicle detector systems of the type employing period shift measurement.

Vehicle detector systems are known which employ the principles of period shift measurement in order to determine the presence of a vehicle in or adjacent to an inductive loop mounted on or in a roadway. In such systems, a first oscillator, which typically operates in the range from about 20 to about 50 Khz, is used to produce a periodic signal in a vehicle detector loop. A second oscillator operating at a much higher frequency is commonly used to generate a sample count signal over a fixed number of loop cycles. The relatively high frequency count signal is typically used to increment a counter which stores a number corresponding to the sample count at the end of the fixed number of loop cycles. This sample count is compared with a reference count representative of a previous count in order to determine whether a vehicle has entered or departed the region of the loop.

The initial reference value is obtained from a sample count and stored in a reference counter. Thereafter, successive sample counts are obtained on a periodic basis, and compared with the reference count. If the two values are essentially equal, the condition of the loop remains unchanged, i.e., a vehicle has not entered the loop. However, if the two numbers differ by at least a threshold amount in a first direction (termed the Call direction), the condition of the loop has changed and may signify that a vehicle has entered the loop. More specifically, in a system in which the sample count has decreased and the sample count has a numerical value less than the reference count by at least a threshold magnitude this change signifies that the period of the loop signal has decreased (since fewer counts were accumulated during the fixed number of loop cycles), which in turn indicates that the frequency of the loop signal has increased, usually due to the presence of the vehicle in or near the loop. When these conditions exist, the vehicle detector generates a signal termed a call signal indicating the presence of a vehicle in the loop.

Correspondingly, if the difference between a sample count and the reference count is greater than a second threshold amount, (i.e., the sample count plus 5 counts is the second threshold amount is larger than the reference count), this condition indicates that a vehicle which was formerly located in or near the loop has left the vicinity. When this condition obtains, a previously generated call signal is dropped.

The call signals are used in a wide variety of applications, including vehicle counting along a roadway or through a parking entrance or exit, vehicle speed between preselected points along a roadway, vehicle presence at an intersection controlled by a traffic control light system or in a parking stall, and numerous other applications. In all applications, it is necessary to periodically update the reference value so that the vehicle detector system can be dynamically adjusted to varying conditions. For example, the loop wire, connecting cables and associated electronic analog circuitry are typically subject to widely varying temperature conditions, which cause the frequency of the loop signal to vary in a somewhat unpredictable manner. If the loop frequency drifts between sample periods by an amount equivalent to the period threshold count in the Call direction, a false call will be detected (since the sample count will be less than the reference count by the threshold value), even though no vehicle has actually entered the loop. This false call will be manifested by a green light in the lane controlled by the detector issuing the false call, even though no vehicle is present in that lane. This is clearly highly undesirable as it adversely affects vehicle flow through a controlled system.

In the past, the problem of loop frequency drift has been addressed by a number of techniques. According to one known technique, the reference is slowly adjusted (typically once every 2 seconds) after taking the sample count by examining the difference between the sample count and the reference and (a) decrementing the reference by one count when the sample count is less than the reference and (b) incrementing the reference by one count whenever the sample count exceeds the reference. This technique suffers from several disadvantages. Firstly, while the slow tracking of the loop drift afforded by this approach from the No Call to Call direction is desirable, it is highly undesirable in the opposite direction (i.e., the Call to No Call direction). This is principally due to the fact that, starting with the Call condition the reference is decremented to an artificially low value (typically 100 counts or more below the previous No Call reference value). If the vehicle which generated the call leaves the loop and another vehicle enters the loop, this new Call condition will not be detected, since the new sample count will not be less than the current reference value until the reference is incremented by the testing threshold amount (which would take many cycles). As a result, the newly entered vehicle will not be serviced by the traffic control system (i.e., issuance of a green).

In an attempt to avoid this disadvantage, a modification of this first technique has been developed which decrements the reference (typically once every 2 seconds) when the sample count is less than the reference value (the same as the decrementing in the first technique), but which changes the reference to the sample count whenever the sample count exceeds the current reference value. This technique introduces another disadvantage. Specifically, when a noise pulse is generated in the loop which causes the sample count to erroneously rise in value by a significant amount, which is a common occurrence, the new reference value is incorrectly set to an artificially high value. When the noise disappears (typically before the next sample count is taken), the new sample count drops back to the nominal No Call value, which causes a false call to be registered, with the observable disadvantages noted above. Further, since the reference is only decremented (typically once every 2 seconds), it may take a long period of time (possible hours) for the reference to be readjusted to the nominal No Call value. During this period of adjustment, false calls are registered for each successive sample, and false greens are issued for the same period of time, which totally disrupts the traffic control system.

Still further compounding this problem is the fact that an intermittent open loop can also disrupt the reference adjustment process by suddenly raising the loop inductance, which causes a corresponding increase in the sample count. For the case of a shorted loop, the reference value is gradually decremented to the extremely small value of the sample count registered by the shorted loop during which time a false call will be registered. If the short self-corrects with a vehicle in the loop, the next sample count will exceed that of the invalid reference value and no call will be detected. The new reference will then be adjusted to the sample count obtained with the vehicle. However, since no call will be generated so long as the vehicle remains in the loop, the vehicle will never obtain a green signal, which is highly undesirable.

As noted above, in order to register a call from the No Call condition, the count sample must be smaller than the reference value by a threshold amount. This threshold amount is necessary in order to avoid jitter around zero and sample count changes due to vibration of vehicles in or adjacent the loop, which can cause slight changes in the sample count value. In order to avoid these two effects, vehicle detector systems have been designed with fixed hysteresis for the Call/No Call conditions. In one popular system, two thresholds have been employed: A first threshold of 8 counts between the reference value and the sample count in the No Call to Call direction, and a second value of 5 counts in the Call to No Call direction. Specifically, in order to register a call the difference between the reference and the sample count must be at least 8; while to register a No Call from a Call condition the difference between the reference value and the sample count must be at least 5. While fixed hysteresis has been found useful, it suffers from the disadvantage that different applications optimally require different hysteresis values. For example, in traffic intersection control applications, the 8, 5 fixed hysteresis values function well. However, for parking applications in which the vehicle traffic moves quite slowly a vibrating metal part on a vehicle (e.g, the bumper) causes vibration changes to the sample count which are greater than the three count difference in the 8, 5 fixed hysteresis system. Consequently, for such applications greater hysteresis must be used, such as a difference of at least 12 for a call to be registered and a difference of five or less for the call to be extinguished. As a result of these differing hysteresis requirements, systems in the past have been specially designed for specific applications with fixed hysteresis, which requires a large number of different models of the same basic vehicle detector in order to meet consumer demands.

SUMMARY OF THE INVENTION

In a first aspect, the invention comprises a method for updating a reference count in a vehicle detector system having a loop subject to ambient inductance changes which substantially reduces adverse noise effects, prevents false operation of the detector system in the presence of a shorted or open loop condition, and enables automatic recovery of the vehicle detector system when an open or shorted loop self-corrects. In a first embodiment, the method is performed by generating a sample count representative of loop inductance, comparing the sample count with a reference count, and replacing the reference count with the sample count whenever the sample count exceeds the reference count for a predetermined time period. In this embodiment, when the sample count first exceeds the reference count, a timer is started. Successive sample counts are taken and compared against the reference count. If each successive sample count exceeds the reference count up until the end of the timer period, the reference count is updated to the most recent sample count when the timer times out. If any sample count does not exceed the reference count while the timer is operating, the timer is stopped and reset. The timer is restarted thereafter whenever a sample count next exceeds the reference count. In one specific embodiment, the timer period is selectable between two different values to provide flexibility of operation for the system in different applications.

In an alternate embodiment of the invention, the successive comparisons between the sample counts and the reference count are conducted for a predetermined number of samples. If each sample count exceeds the reference count for the predetermined number of sample, the reference count is updated to the value of the most recent samples. If any one of the sample counts does not exceed the reference count before the predetermined number of sample counts is taken, the counter measuring the number of sample counts is reset to zero and the method begins anew. In a specific embodiment of the invention, the number of samples taken before permitting updating of the reference count is selectable between two different values to provide flexibility for the vehicle detector system in a wide variety of applications.

In both of the above embodiments, the detection of an open or shorted loop condition overrides the conditional updating of the reference and freezes the reference value until such time as the open or shorted condition is corrected. This is effected by preventing replacement of the reference count with a sample count whenever the sample count differs from the reference count by a predetermined threshold value which is substantially larger than any expected short term change in the value of the sample count due to the presence or absence of a vehicle in the loop. In one specific embodiment, this freeze threshold is set at $\pm 12.5\%$ of the current reference count.

In another aspect of the invention, the two embodiments noted above for updating the reference are combined with additional method steps for controlling the updating of the reference count. In particular, a guard band is provided at the zero difference threshold between the sample count and reference count to eliminate jitter and vibratory effects, the guard band preferably comprising three counts. In addition, gradual tracking of the reference count in the call direction is provided by decrementing the reference count in a preselected manner whenever the value of the sample count minus the reference count is less than zero. The combined effect of the conditional reference updating in the no call direction, the guard band and the gradual tracking in the call direction provides fast tracking in the No Call direction while substantially eliminating adverse noise effects, suspension of the reference updating process in the presence of an open or shorted loop while allowing return of the detector system to normal operation if the open or shorted condition self-corrects (or is otherwise corrected), a substantial reduction of jitter and vibratory noise effects, and gradual tracking of the reference count in the call direction.

In another aspect of the invention, variable hysteresis is provided for the Call/No Call signal generation by including in the vehicle detector system means for enabling the selection of at least two different threshold values required to establish a call condition. This aspect of the invention enables a single vehicle detector to be used in a wide variety of applications requiring different call condition establishing parameters.

For a fuller understanding of the nature and advantages of the invention, reference should be had to the ensuing detailed description taken in conjunction with the accompanying drawings.

DESCRIPTION OF THE PREFERRED EMBODIMENTS

Figure 1:
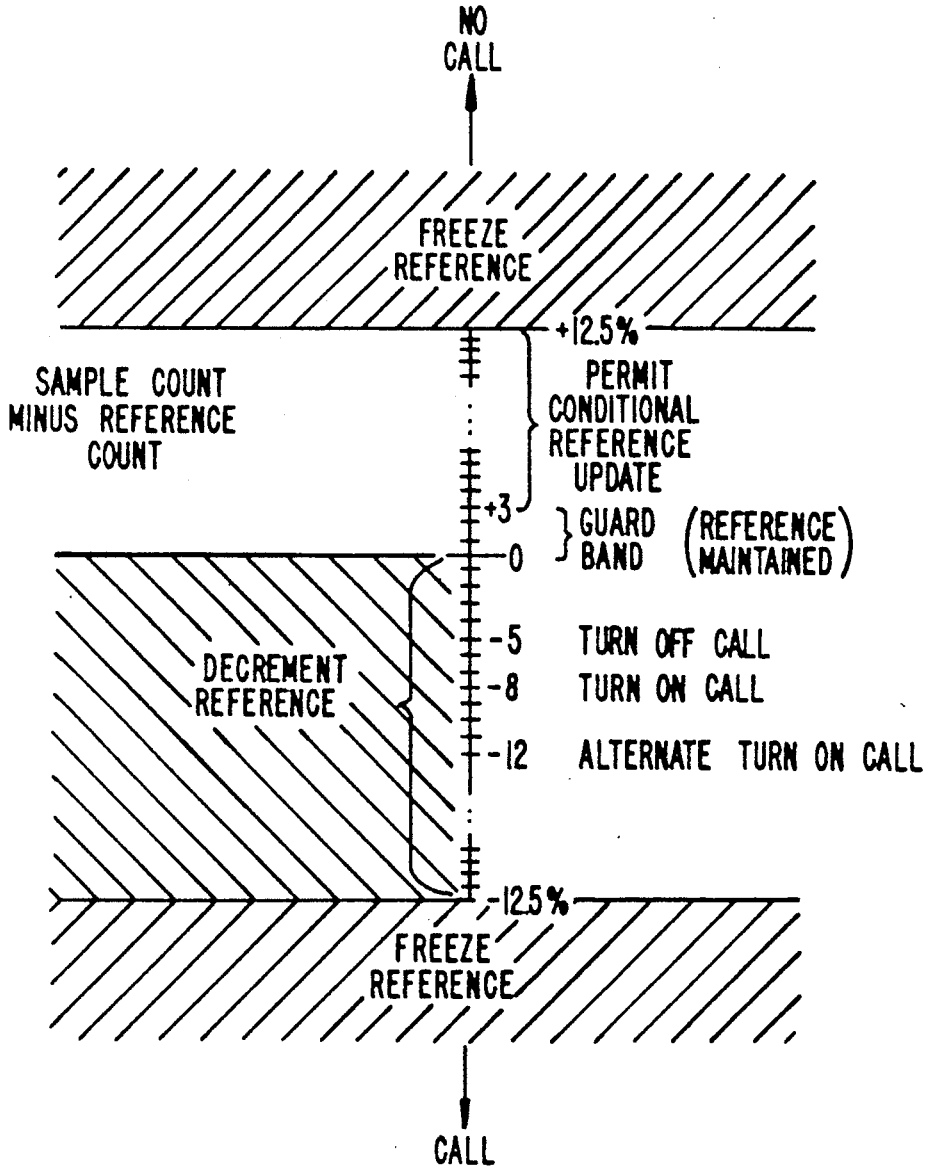
FIG. 1 is a schematic diagram illustrating the several embodiments of the invention.

Turning now to the drawings, FIG. 1 is a plot of the value of sample count minus reference count which illustrates the manner in which the reference count in a vehicle detector is maintained or updated. It is understood that the reference count is a numerical value stored in a counter in the vehicle detector system and is representative of either an initial or a recent value of the inductive state of the vehicle detector loop. The sample count is a numerical value stored in a counter which is obtained by gating the output of a high speed oscillator to the input of the sample counter for a preselected number of loop oscillator cycles. After the sample counter has been incremented by the high frequency oscillator for the predetermined number of loop oscillator cycles, the sample counter is disabled and the contents thereof are compared with the contents of the reference counter. After the comparison is completed, the sample counter is reset and subsequently enabled to accumulate another sample.

As seen in FIG. 1, there are several numerical regions plotted on a vertical scale. The zero reference level corresponds to equal values of the sample count and the reference count. Regions above the zero level represent positive values of the difference obtained by subtracting the reference count from the sample count, while regions below the zero level represent negative values of this difference. In the numerical range from 0 to +3, representing a guard band to filter out the jitter and vibration induced changes in the value of the sample count, the reference is maintained, i.e., is not updated. In positive regions extending from +3 to the value designated +12.5%, conditional updating of the reference count is permitted. The manner in which the conditional reference updating is conducted in this positive region varies in accordance with the two specific embodiments.

In the first embodiment, which uses a timing function, the updating proceeds as follows. The first time that the sample count minus reference count difference exceeds the value of +3, a timer is started. The timer has a predetermined time out period which is preselected. Each time that a subsequent sample count minus reference count difference lies in the range between the +3 value and the value designated +12.5%, the operation of the timer is not affected. Thus, the timer continues to run while several successive difference measurements are obtained. When the timer times out, the value of the last sample count is placed in the reference counter so that the reference count assumes the value of that sample count. If during the operation of the timer any difference value does not exceed the value of +3, the timer is stopped and reset to zero. The timer remains at zero until the next difference value exceeds the value of +3, at which time the timer is restarted.

In a second embodiment of the invention, the conditional reference updating is performed using a number of samples counter. This counter accumulates the number of times a sample count is taken or the number of difference measurements taken and is started whenever the value of the sample count minus the reference count exceeds the value of +3. For each successive complete sample count taken, the number of samples counter is incremented by one. After a predetermined number of samples has been consecutively taken and the difference value for each sample count has exceeded the value of +3, the value of the most recent sample count is set into the reference counter to update the reference count. If any difference value does not exceed the value of +3 during this process, the number of samples counter is reset to zero and the process is restarted.

In both of the embodiments described above, if the value of the difference exceeds the upper limit of +12.5%, the conditional reference process is aborted and the reference count is frozen in the reference counter until such time as a new difference value drops below this upper limit. The region beyond +12.5% is considered to represent an open loop condition under which the vehicle detector system is inoperable.

The above described operation of the reference count conditional updating in the No Call direction provides for relatively fast updating of the reference count, when permitted, but filters out jitter, vibration induced changes in the sample count, and noise pulses present in the vehicle detector loop. In addition, the freeze reference operation preserves the last valid reference count before the open loop condition occurred, which permits resumption of normal operation if the open self-corrects (or is otherwise corrected).

The operation of the reference updating method in the call direction proceeds as follows. Whenever the sample count minus reference count value is below zero, the reference counter is decremented in a preselected manner by a predetermined value (preferably one count) until the sample count minus the reference count is zero or greater. The manner in which the decrementing is performed depends on two different operator selected parameters: Mode and sensitivity, and on the value of the sample count minus the reference count. These operations are described in detail below and permit gradual tracking of the reference count in the call direction to follow long term drift of the loop inductance in the call direction. However, if the value of sample count minus reference count exceeds the −12.5% boundary value, which represents a shorted loop condition, the value of the reference count is frozen. This preserves the last valid reference count established before the shorted loop condition occurred. If the shorted loop condition self-corrects (or is otherwise corrected), the decrementing of the reference count in the call direction is automatically resumed.

It should be understood that the 12.5% count boundaries are representative numerical values only, and that other percentage boundaries may be selected, if desired. In one specific embodiment of the invention, for example, boundaries of 10% have been selected. Other values may be employed, as desired. In general, the freeze reference boundary value should be substantially beyond the expected difference values experienced when a vehicle leaves a vehicle detector loop (in the No Call direction) or when a vehicle enters a vehicle detector loop (in the Call direction).

With respect to the timing embodiment described above, a value of 100 m sec. has been found suitable as a time out period for traffic control applications. For parking lot applications, a relatively longer time period is preferred, for example 500 m sec. In the specific embodiment of the invention described below, the vehicle detector is provided with a selectable timing period of either 100 or 500 m sec., so that a single vehicle detector may be used in a wide variety of applications.

In the number of samples counter embodiment described above, a value of 5 for the required number of successive samples which provide measured difference values lying in the permitted range of +3 to +12.5% has been found to provide best results in traffic control applications; while a value of 128 has been found most useful for parking lot applications. Other values may be selected, as desired. In addition, the vehicle detector may be provided with means for selecting the value of more than one number of threshold sample counts (e.g., 5 or 128) so that the vehicle detector may be used in a wide variety of applications.

FIG. 1 also illustrates another aspect of the invention in which variable hysteresis is provided for the Call/No Call operation. With reference to the negative portion of the scale, in order to register a call the sample count minus reference count value must equal or be more negative than a predetermined negative threshold value, which is selectable. In one state, this value is −8 (designated with the legend TURN ON CALL). In another state this value is −12 (designated with the legend ALTERNATE TURN ON CALL). In order to extinguish a call the sample count minus reference count difference is tested against a different threshold −5 (designated with the legend TURN OFF CALL). When the first turn on call threshold of −8 is selected, and beginning with the No Call condition (sample count minus reference count value lying above the −8 value), whenever the sample count minus reference count value is −8 or below −8, a call signal is generated by the vehicle detector. Once the call signal has been generated, this signal will not be extinguished until the sample count minus reference count difference is −5 or above −5. This difference in the two threshold values provides a three count hysteresis band which filters out vibration induced changes in the sample count. When the ALTERNATE TURN ON CALL threshold of −12 is selectcount minus reference count difference value is −12 or below, and the call signal is not extinguished until the sample count minus reference count difference value is −5 or above. This provides a hysteresis band of seven sample counts which is broader than that afforded by the first turn on call threshold of −8. In the specific embodiment described below, the TURN ON CALL threshold can be selected by the operator to tailor the operation of the vehicle detector to a specific application. In general, the −8 TURN ON CALL threshold has been found to provide best results with traffic control applications, while the alternate TURN ON CALL threshold of −12 has been found to provide superior results with sliding gate and parking lot control applications. As noted above, the manner in which the reference count is decremented in the Call direction depends upon the difference value of the sample count minus the reference count, and two operator selected parameters: Mode and Sensitivity.

There are seven different Mode settings and eight different sensitivity settings. Seven Mode settings and each Sensitivity setting specify a decrementing period which determines the rate at which the reference count is decremented in the call direction. The time at which decrementing begins depends upon the negative range in which the sample count minus reference count difference lies and the mode setting. For values between zero and the TURN ON CALL threshold, decrementing is controlled as follows:

| | |
|---|---|
| Mode 0 | decrement every two seconds. |
| Mode 2 | decrement every two seconds. |
| Mode 3 | decrement every four seconds. |
| Mode 4 | decrement every eight seconds. |
| Mode 5 | decrement every sixteen seconds. |

Modes 1 to 6—decrement every N seconds, where N is determined by sensitivity setting as follows:

| Sensitivity Setting | N (Seconds) |
|---|---|
| 0 | 180 |
| 1 | 80 |
| 2 | 40 |
| 3 | 18 |
| 4 | 8 |
| 5 | 4 |
| 6 | 2 |
| 7 | 1 |

For values below the TURN ON CALL threshold, decrementing is controlled as follows:

Mode 0—wait 2 seconds after Call starts, if call persists, set reference count equal to sample count.

Mode 2—wait 4 minutes after Call starts, if call persists, decrement reference count every 2 seconds.

Mode 3—wait 4 minutes after Call starts, if call persists, decrement reference count every 4 seconds.

Mode 4—wait 4 minutes after Call starts, if call persists, decrement reference count every 8 seconds.

Mode 5—wait 4 minutes after Call starts, if call persists, decrement reference count every 16 seconds.

Mode 6—wait 4 minutes after Call starts, if call persists, then decrement reference count every N seconds, where N is determined by the sensitivity setting in accordance with the above sensitivity table.

Mode 1—decrement reference count every N seconds, where N is determined by the sensitivity setting in accordance with the above sensitivity table.

If the call does not persist for 2 seconds in Mode 0 or 4 minutes in Modes 2–6, the reference count is immediately decremented when the call signal is extinguished, provided that the sample count minus the reference count is still negative.

Figure 2A:
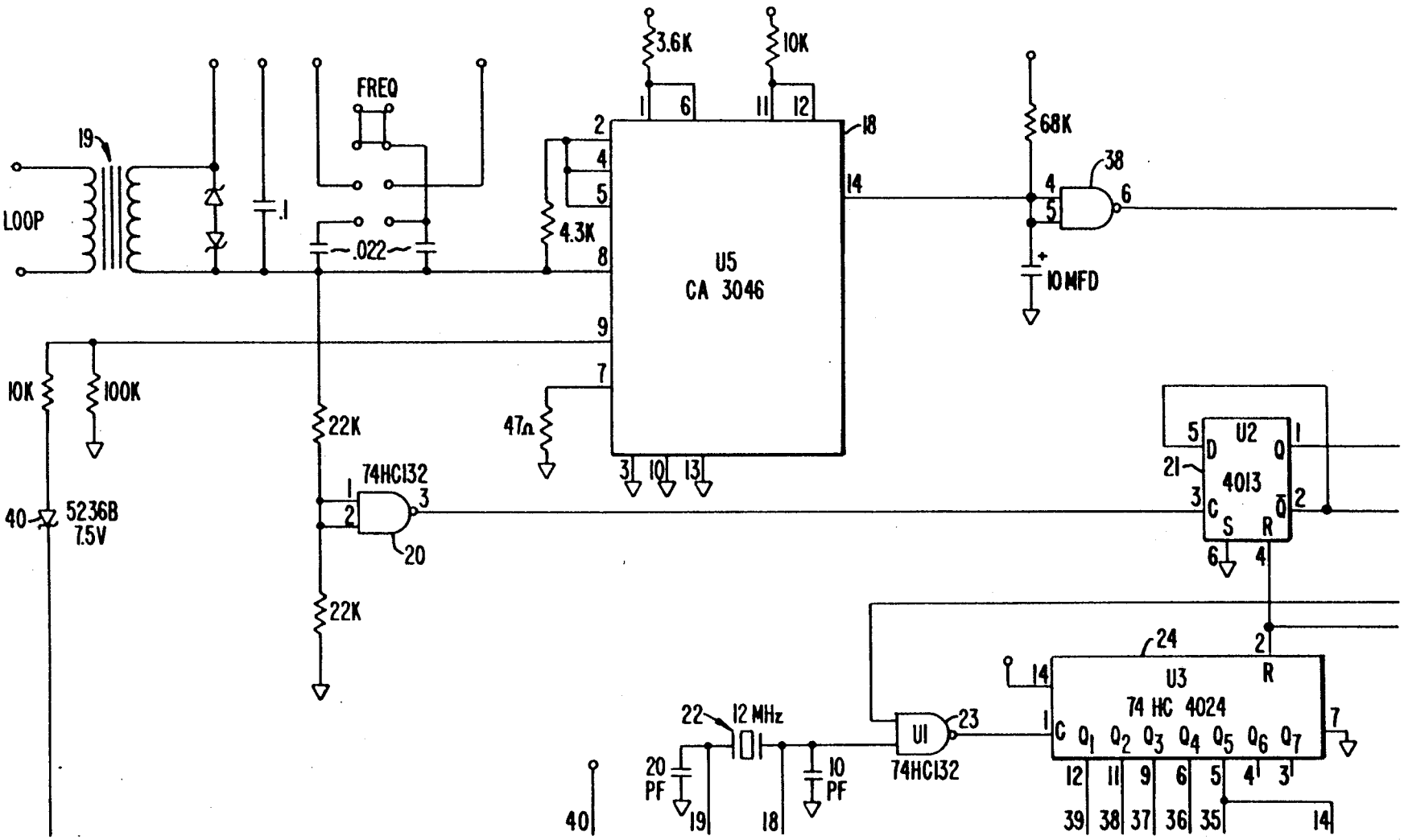
FIGS. 2*a*, 2*b*, 2*c* and 2*d* are diagrams of a microprocessor implemented system incorporating the several embodiments of the invention.
Figure 2B:
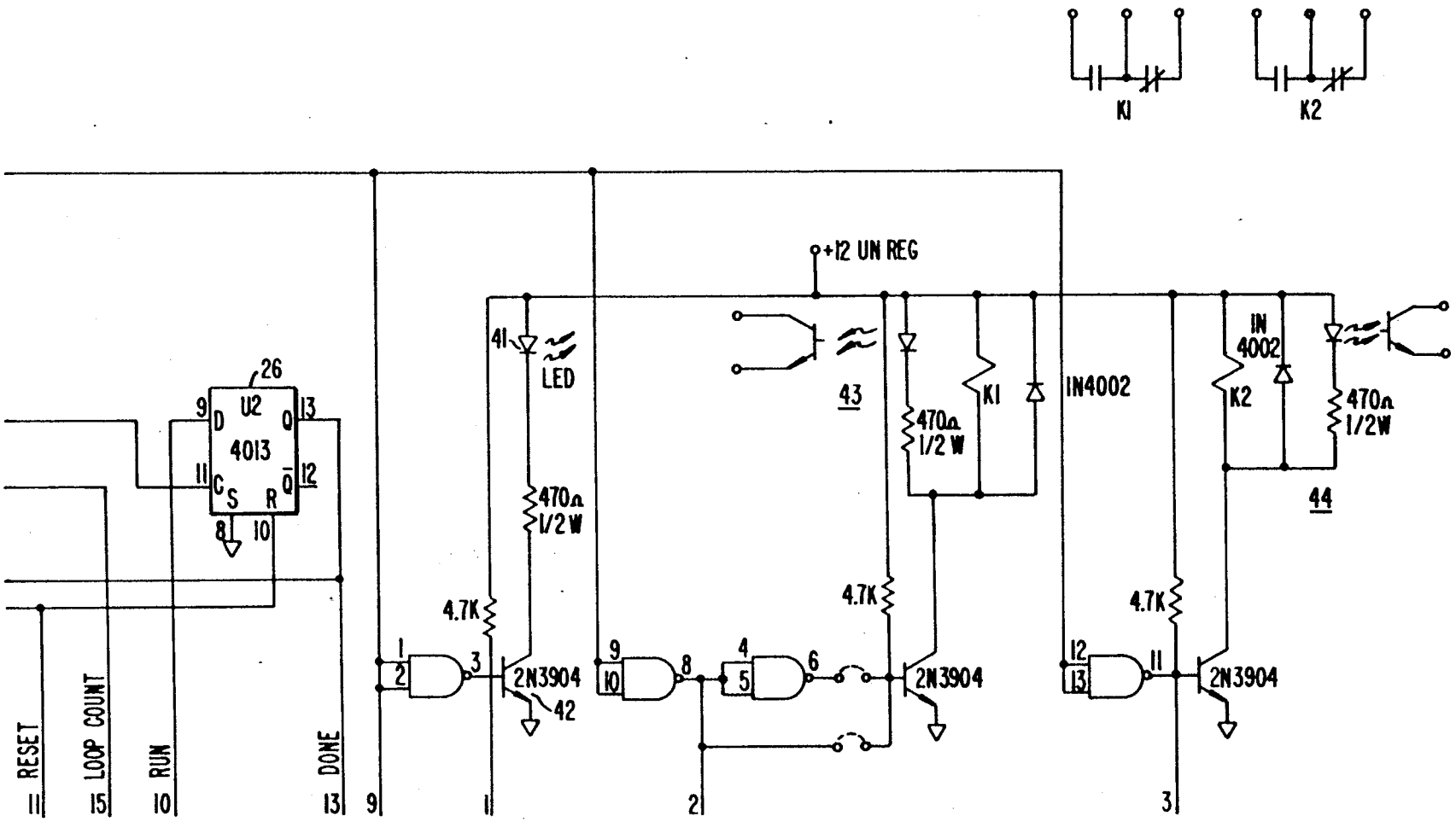
Figure 2C:
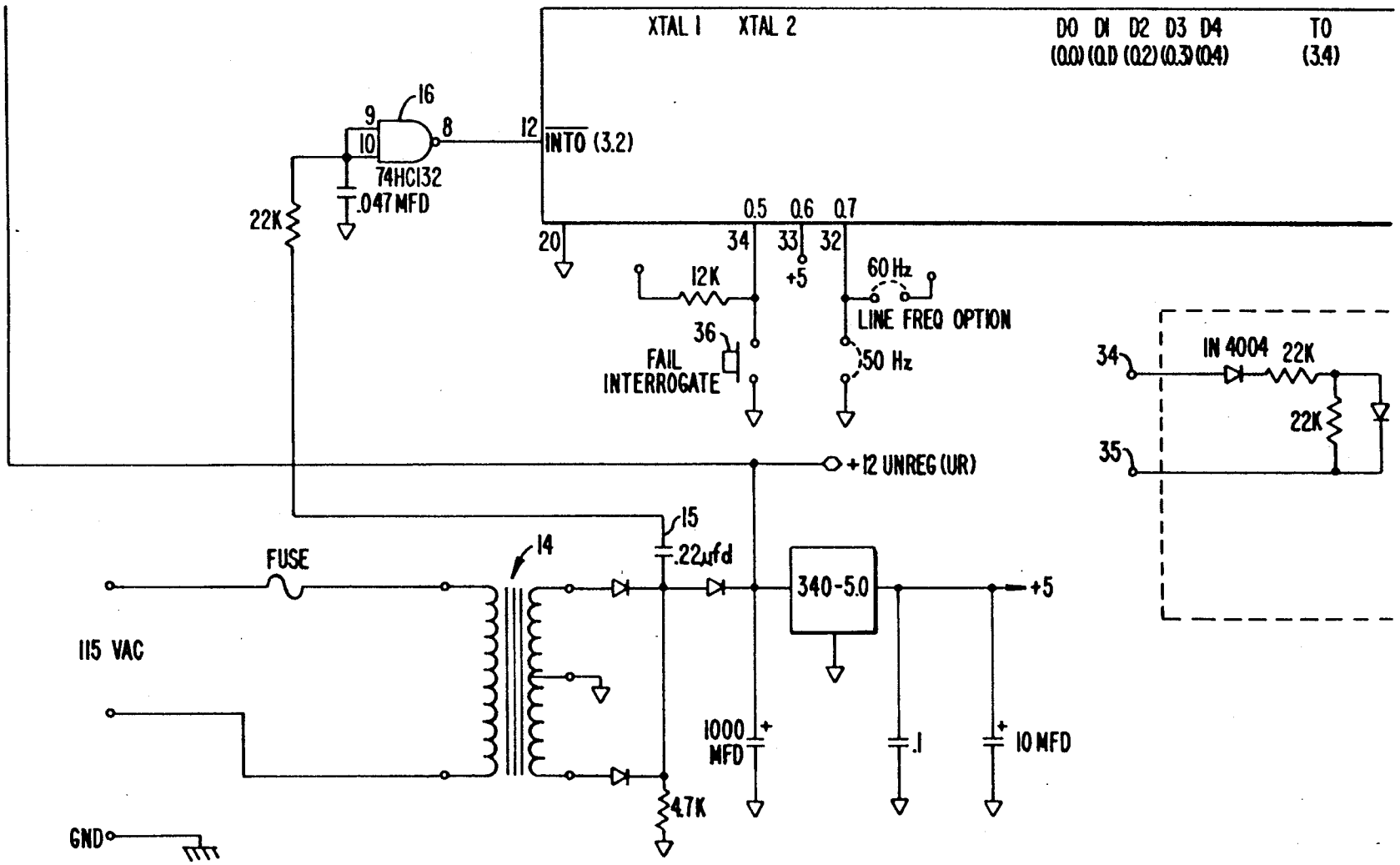
Figures 2, 2D:
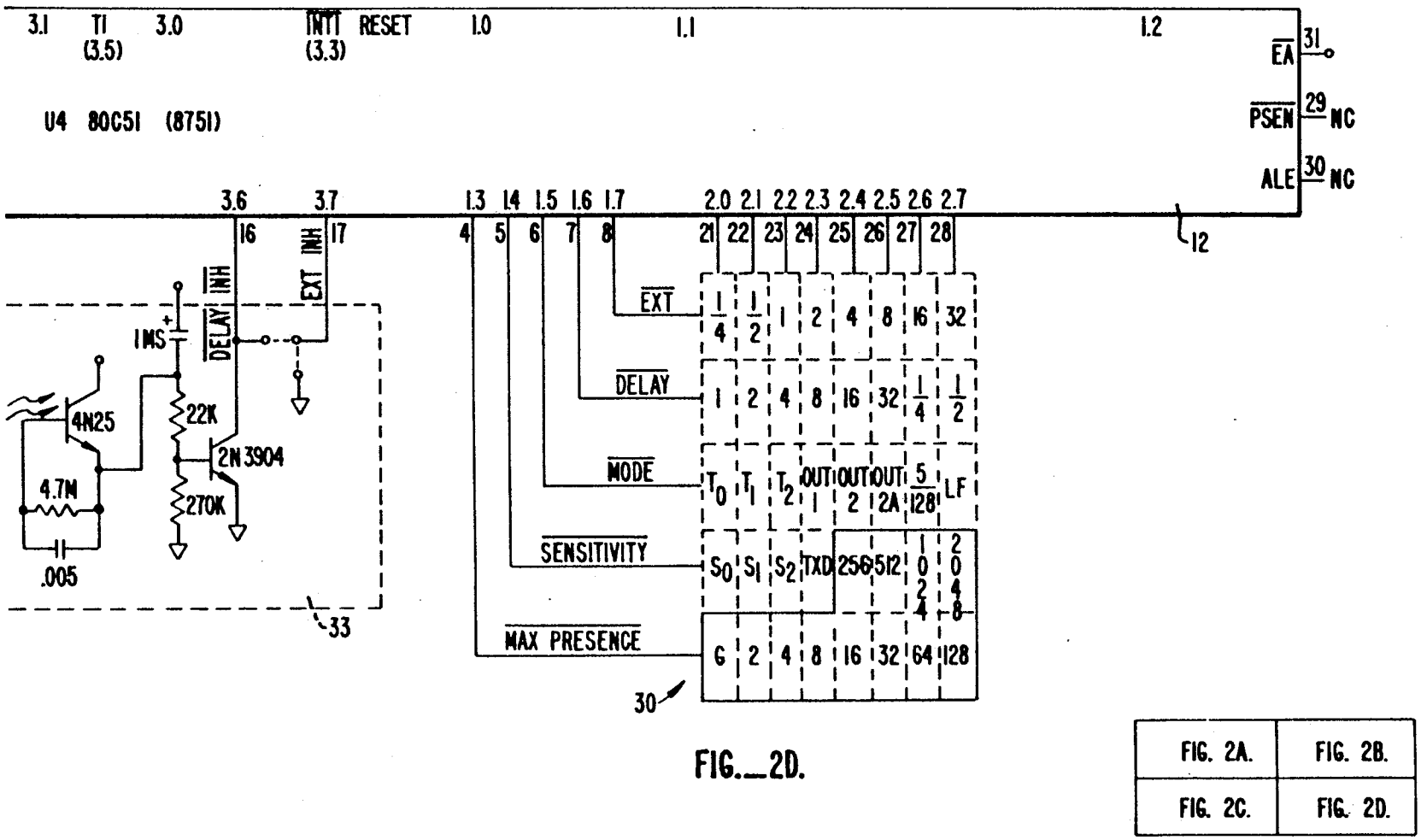

FIG. 2 illustrates in schematic form a microprocessor based vehicle detector incorporating the timer based conditional reference updating, the freeze reference technique, the guard band, alternate turn on call threshold and Call direction reference decrementing aspects of the invention described above. As seen in FIG. 2, a microprocessor 12, preferably a type 8751 microprocessor, is provided with a real time clock input derived from an AC source via a transformer 14, a capacitor 15 and a gate circuit 16 coupled to port 3.2 of the microprocessor 12. A loop oscillator 18 providing a nominal loop frequency in the range from about 20 to about 50 Khz drives a vehicle detector loop (not shown) via transformer circuit 19. The loop frequency is coupled via a gate 20, which functions as a Schmitt trigger to square up the sinusoidal loop signal, into the clock input of a loop count flipflop 21, the output of which is coupled to port 3.5 of the microprocessor 12 as a loop count reference signal. A high frequency 12 Mhz crystal oscillator circuit 22 provides a high frequency counting signal via a gate 23 to the input of an external sample counter 24, which is preferably a type 74HC4024 integrated circuit. The Q1–Q5 outputs of circuit 24 are coupled to the D0–D4 and T0 (3.4) input ports of the microprocessor 12. Internal to microprocessor 12 are additional counter stages for configuring the sample count register in conjunction with external circuit 24. The high frequency counting signal produced by crystal oscillator circuit 22 is gated by a control flipflop 26, which is enabled by the presence of a run signal at the D input thereto latched by a clock signal provided from flipflop 21. The run signal is generated by the microprocessor.

A plurality of strobe lines emanating from ports 1.3–1.7 of microprocessor 12 are connected to individual rows of a cross point matrix 30, the columns of which are coupled to input ports 2.0–2.7 of microprocessor 12 and provide operator selectable data inputs for extension times, delay times, mode, presence and sensitivity values. The magnitude of the time out period for conditional reference updating (i.e., 100 or 500 m sec.) is established by bit 6 of the mode row of matrix 30 (i.e., the input to port 2.6). The default value is 100 m sec., while 500 m sec. can be selected by inserting the diode in the matrix. The value of the selectable hysteresis for the Call/No Call signal generation is selected by bit 7 of the mode row of matrix 30 (i.e., the input to port 2.7). The default value is −8, while the −12 value can be selected by inserting the diode.

A delay/extension inhibit circuit 33 has a pair of input terminals 34, 35 coupled to the green light circuit of the associated traffic control system, a delay inhibit terminal connected to port 3.6 of microprocessor 12 and an extension inhibit terminal coupled to port 3.7 of microprocessor 12.

A fail interrogate switch 36 is coupled to port 0.5 of microprocessor 12 which permits an operator to interrogate an internal flag bit which is set whenever a loop fail condition is sensed by the microprocessor 12.

A power on reset gate 38 has an input coupled to a zener diode via circuitry within a loop oscillator circuit 18 and an output coupled to the reset input of microprocessor 12 and functions to reset the microprocessor upon power up and whenever the operating voltage for the system drops below a threshold value set by the zener diode 40.

A call indicator diode 41 is driven from port 1.0 of microprocessor 12 via a driving transistor 42, which is preferably a type 2N3904 transistor.

A true presence output circuit 43 is driven from port 1.1 of microprocessor 12, while a conditioned presence circuit 44 is driven by port 1.2 of microprocessor 12.

A complete software listing for the system shown in FIG. 2 is incorporated in Appendix A. The system described in the software and the hardware of FIG. 2 implements the timer based conditional reference count update embodiment. In order to implement the number of sample counts conditional reference count update embodiment, the software must be reconfigured to provide a number of samples counter, and the 2.6/mode bit is used to specify the alternate number of threshold sample counts (i.e., either 5 or 128). Such changes are well within the capability of one of ordinary skill in the art.

While the above provides a complete and adequate description of the preferred embodiment of the invention, various modifications, alternate constructions and equivalents will occur to those skilled in the art. Therefore, the above should not be construed as limiting the invention, which is defined by the appended claims.

What is claimed is:

1. A method for updating a reference count in a vehicle detector system having a loop subject to drift in both the vehicle call direction and the vehicle no call direction, said method comprising the steps of:

(a) generating a sample count representative of loop inductance;

(b) comparing the sample count with a reference count;

(c) repeating steps (a) and (b) at selected intervals; and (d) replacing the reference count with a sample count whenever the difference between each successively generated sample count and the reference count continuously indicates loop drift in the no call direction for a predetermined time period longer than the selected interval.

2. The method of claim 1 wherein said step of replacing includes the steps of starting a timer whenever the difference between the sample count and the reference count first assumes a no call direction value and resetting the timer whenever the difference between the sample count and the reference count assumes a call direction value before the timer reaches the predetermined time period.

3. The method of claim 1 wherein said predetermined time period is selectable.

4. The method of claim 1 wherein said predetermined time period is 100 m sec.

5. The method of claim 1 wherein said predetermined time period is 500 m sec.

6. The method of claim 1 further including the step of preventing replacement of the reference count with the sample count whenever the sample count differs from the reference count by a predetermined maximum threshold value.

7. A method for updating a reference count in a vehicle detector system having a loop subject to drift in both the vehicle direction and the vehicle no call direction, said method comprising the steps of:

(a) generating a sample count representative of loop inductance;

(b) comparing the sample count with a reference count;

(c) repeating steps (a) and (b) at selected intervals; and (d) replacing the reference count with a sample count whenever the difference between each successively generated sample count and the reference count successively indicates loop drift in the no call direction for a predetermined number of samples greater than one.

8. The method of claim 7 wherein said step of replacing includes the steps of incrementing a counter when the difference between the sample count and the reference count first assumes a no call direction value and resetting the counter whenever the difference between the sample count and the reference count assumes a call direction value before the counter reaches a count equivalent to said predetermined number of samples.

9. The method of claim 7 wherein said predetermined number of samples is selectable.

10. The method of claim 7 wherein said predetermined number of samples is five.

11. The method of claim 7 wherein said predetermined number of samples is 128.

12. The method of claim 7 further including the step of preventing replacement of the reference count with the sample count whenever the difference between the sample count and the reference count exceeds a predetermined maximum threshold value.

13. In a vehicle detector system having a loop subject to drift in both the vehicle call direction and the vehicle no call direction, a method of tracking variations in loop inductance comprising the steps of:

(a) establishing a loop inductance reference value REF;

(b) generating a sample count SAMPLE representative of measured loop inductance;

(c) testing the value of the sample count against the reference value; and (d) modifying the reference value as a result of the testing step by:

(i) changing the reference value by a predetermined amount in a preselected manner when the difference between SAMPLE and REF assumes a call direction value;

(ii) changing the reference value to the SAMPLE count when the difference between SAMPLE and REF assumes a no call direction value greater than a guard band threshold value for a minimum time period or a predetermined number of samples.

14. The method of claim 13 wherein said step of modifying further includes the step of freezing the reference value when the difference between SAMPLE and REF exceeds a predetermined maximum value.

15. The method of claim 13 wherein said step (i) of changing is performed every N seconds, where N is an integer.

16. The method of claim 15 wherein N is selectable.

17. The method of claim 15 wherein said step (i) of decrementing is delayed by an initial time period whenever a Call condition is present.

18. The method of claim 17 wherein said initial time period is substantially longer than the decrementing rate N.

19. The invention of claim 15 wherein said step (i) of decrementing is initiated when the Call condition is extinguished.

20. The method of claim 13 wherein said step (i) of changing is performed every N seconds, where N is a real number.

21. The method of claim 20 wherein N is selectable.

22. The method of claim 20 wherein said step (i) of changing is delayed by an initial time period whenever a Call condition is present.

23. The method of claim 22 wherein said initial time period is substantially longer than the value N.

24. The invention of claim 20 wherein said step (i) of changing is initiated when the Call condition is extinguished.

25. A method of tracking variations in loop inductance of a detector loop in a vehicle detector system having a TURN ON CALL threshold C in the vehicle call direction and a guard band threshold G in the vehicle no call direction, said method comprising the steps of:

(a) establishing a loop inductance reference value REF;

(b) generating a sample count SAMPLE representative of measured loop inductance;

(c) testing the value of each sample count against the reference value; and (d) modifying the reference value as a result of the testing step by:

(i) changing the reference value to the SAMPLE COUNT when the difference between SAMPLE and REF assumes a no call direction value G for a minimum time period or a predetermined number of samples;

(ii) changing the reference value by a predetermined amount every N seconds, where N is a real number, when the difference between SAMPLE and REF assumes a call direction value greater than zero and less than C;

(iii) waiting for an initial period and then changing the reference value by a predetermined amount every N seconds, where N is a real number, when the difference between SAMPLE and REF assumes a call direction value at least equal to C for at least the initial period.

26. The method of claim 25 wherein N is selectable.

27. The method of claim 25 wherein said initial time period is substantially longer than the decrementing rate N.

28. The method of claim 25 wherein N is selectable.

29. The method of claim 25 wherein said step of modifying further includes the step of freezing the reference value when SAMPLE - REF exceeds a predetermined maximum value.

30. The method of claim 25 wherein N is selectable.

31. In a vehicle detector system having a loop subject to drift in both the vehicle call direction and the vehicle no call direction, the improvement comprising means for generating a succession of sample counts each representative of loop inductance at the time of generation of the respective sample count, means for comparing each sample count with a reference count, and means for replacing the reference count with a sample count whenever the difference between each successively generated sample count and the reference count continuously indicates loop drift in the no call direction for a predetermined time period longer than the time interval between sample counts.

32. The invention of claim 31 wherein said replacing means includes a timer, means for starting the timer whenever the difference between the sample count and the reference count first assumes a no call direction value, and means for stopping the timer whenever the difference between the sample count and the reference count assumes a call direction value before the timer reaches a value signifying the predetermined time period.

33. The invention of claim 31 further including means for enabling selection of said predetermined time period.

34. The invention of claim 31 further including means for preventing replacement of the reference count with the sample count whenever the difference between the sample count and the reference count exceeds a predetermined maximum threshold value.

35. In a vehicle detector system having a loop subject to drift in both the vehicle call direction and the vehicle no call direction, the improvement comprising means for generating a successions of sample counts each representative of loop inductance at the time of generation of the respective sample count, means for comparing each sample count with a reference count, and means for replacing the reference count with a sample count whenever the difference between each successively generated sample count and the reference count successively indicates loop drift in the no call direction for a predetermined number of samples greater than one.

36. The invention of claim 35 wherein said replacing means includes a counter, means for periodically incrementing the counter when the difference between the sample count and the reference count first assumes a no call direction value, and means for stopping the counter whenever the difference between the sample count and the reference count assumes a call direction value before the counter reaches a count equivalent to said predetermined number of samples.

37. The invention of claim 35 further including means for enabling selection of said predetermined number of samples.

38. The invention of claim 35 further including means for preventing replacement of the reference count with the sample count whenever the difference between the sample count and the reference count exceeds a predetermined maximum threshold value.

39. For use in a vehicle detector installation having a loop subject to drift in both the vehicle call direction and the vehicle no call direction, a system for tracking variations in loop inductance comprising:

means for establishing a loop inductance reference value REF;

means for generating a sample count SAMPLE representative of measured loop inductance;

means for testing the value of the sample count against the reference value; and means for modifying the reference value as a result of the testing step by:

(i) changing the reference value by a predetermined amount in a preselected manner when the difference between SAMPLE and REF assumes a call direction value;

(ii) changing the reference value to the sample count when the difference between SAMPLE and REF assumes a no call direction value greater than a guard band threshold value for a minimum time period or a predetermined number of samples.

40. The invention of claim 39 wherein said modifying means further includes means for freezing the reference value when the difference between SAMPLE and REF exceeds a predetermined maximum value.

41. The invention of claim 39 wherein said modifying means includes means for specifying a rate N at which the changing operation (i) is performed.

42. The invention of claim 41 wherein said specifying means includes means for enabling operator selection of said rate N.

43. The invention of claim 41 wherein said modifying means further includes means for delaying the performance of the changing operation (i) for an initial time period whenever a call condition is present.

44. The invention of claim 43 wherein said delaying means includes means for enabling operator selection of said initial time period.

45. The invention of claim 43 wherein said modifying means further includes means for enabling the changing operation (i) to be immediately performed when the call condition is extinguished.

46. A system for tracking variations in loop inductance of a detector loop in a vehicle detector installation having a TURN ON CALL threshold C in the vehicle call direction and a guard band threshold G in the vehicle no call direction, said system comprising:

means for establishing a loop inductance reference value REF;

means for generating a sample count SAMPLE representative of measured loop inductance;

means for testing the value of each sample count against the reference value; and means for modifying the reference value as a result of the testing step by:

(i) changing the reference value to the sample count when the difference between SAMPLE and REF assumes a no call direction value greater than or equal to G for a minimum time period or a predetermined number of samples;

(ii) changing the reference value by a predetermined amount every N seconds, where N is a real number, when the difference between SAMPLE and REF assumes a call direction value greater zero and less then C;

(iii) waiting for an initial period and then changing the reference value by a predetermined amount every N seconds, where N is a real number, when the difference between SAMPLE and REF assumes a call direction value at least equal to C for at least the initial period.

47. The invention of claim 46 wherein said modifying means includes means for specifying a rate N at which changing operations (ii) and (iii) are performed.

48. The invention of claim 47 wherein said specifying means includes means for enabling operator selection of said rate N.

49. The invention of claim 46 wherein said modifying means includes means for enabling the changing operation (iii) to be immediately performed when the value of the difference between SAMPLE and REF changes to a call direction value greater than zero and less than C from a previous value at least equal to C.

50. The invention of claim 46 wherein said modifying means further includes means for freezing the reference value when the difference between SAMPLE and REF exceeds a predetermined maximum value.

51. The invention of claim 46 wherein said vehicle detector installation has a TURN OFF CALL threshold T of value lying between zero and C, and wherein said modifying means includes means for enabling the changing operation (iii) to be immediately performed when the value of the difference between SAMPLE and REF changes to a call direction value greater than zero and no greater than T from a call direction value at least equal to C.

* * * * *